310-322
6/5/84 XR 4,453,044

United States Patent [19]

Murphy

[11] 4,453,044

[45] Jun. 5, 1984

[54] ELECTRO-ACOUSTIC TRANSDUCER WITH PLURAL PIEZOELECTRIC FILM

[75] Inventor: Preston V. Murphy, Geneva, Switzerland

[73] Assignee: Lectret S.A., Geneva, Switzerland

[21] Appl. No.: 461,147

[22] Filed: Jan. 26, 1983

[30] Foreign Application Priority Data

Feb. 9, 1982 [FR] France ..... 8202530

[51] Int. Cl.[3] ..... H04R 17/00

[52] U.S. Cl. ..... 179/110 A; 310/322; 310/324; 310/800

[58] Field of Search ..... 179/110 A; 310/800, 310/324, 322, 366; 367/162, 180

[56] References Cited

U.S. PATENT DOCUMENTS

| | | | |
|---|---|---|---|
| 3,792,204 | 2/1974 | Murayama et al. | 179/110 A |
| 3,832,580 | 8/1974 | Yamamuro et al. | 179/110 A |
| 4,295,010 | 10/1981 | Murphy | 179/110 A |

*Primary Examiner*—Harold I. Pitts
*Assistant Examiner*—Danita R. Byrd

[57] ABSTRACT

An acoustic transducer having a plurality of piezoelectric polymer films spaced apart and mounted at their peripheries upon a hollow support member, and physically connected together at center portions such that the films are parallel to each other at the center portions and diverging from each other near the peripheries.

7 Claims, 2 Drawing Figures

ELECTRO-ACOUSTIC TRANSDUCER WITH PLURAL PIEZOELECTRIC FILM

FIELD OF THE INVENTION

This invention relates to acoustic transducers employing piezoelectric polymer films.

BACKGROUND OF THE INVENTION

Acoustic transducers using piezoelectric elements as an oscillator are known in the literature. For example, U.S. Pat. Nos. 3,832,580 and 3,792,204 describe transducers using a single piezoelectric film; an article by Tamura et al. presented in 1978 at the Acoustical Society Meeting in Honolulu describes a pair of piezoelectric films mounted over the upper and lower surfaces of a polyurethane-foam cushion, and U.S. Pat. No. 3,832,580 describes the use of a plurality of piezoelectric elements suspended in various configurations.

For a given alternating-current voltage, a piezoelectric-film transducer typically generates a lower acoustic amplitude than that produced at the same voltage by other types of transducers, such as electrodynamic transducers. This lower voltage sensitivity can lead to an undesirably low amplitude for certain applications, such as telephone receivers, where the signal voltage is low. Furthermore, the piezoelectric film transducers used as microphones or transmitters generate a lower output voltage for a given sound pressure than do other types of transducers, such as electret condensers. Such low output voltages necessitate the use of high-gain amplifiers, which are often undesirable.

The acoustic transducer disclosed in U.S. Pat. No. 4,295,010, which is hereby incorporated by reference, goes a long way toward improving the output of such piezoelectric transducers. It discloses the use of a plurality of piezoelectric films that are mounted and spaced apart at their peripheries and physically connected near their centers by a dot of epoxy adhesive.

SUMMARY OF THE INVENTION

It has been discovered that, by extending the area over which the piezoelectric films are connected together at their centers, one can increase the transducer's output signal without lowering its resonance frequency, or one can increase the resonance frequency without loss of output signal. Preferably the area of attachment is less than about one-third of the total area of the film. In some preferred embodiments the acoustic transducer is designed to convert the sound into an electrical signal, and the films are electically connected and their polarities are selected in such a way that the output voltages or output currents of the films are added when the films oscillate. In some other preferred embodiments the transducer is designed to produce sound, and the films are electrically connected in parallel with their polarities selected in such a way that the films move in the same direction when electically excited.

DESCRIPTION OF THE PREFERRED EMBODIMENT

The structure and operation of the presently preferred embodiment of the invention will now be described, after first briefly describing the drawings.

DRAWINGS

STRUCTURE

Figure 1:
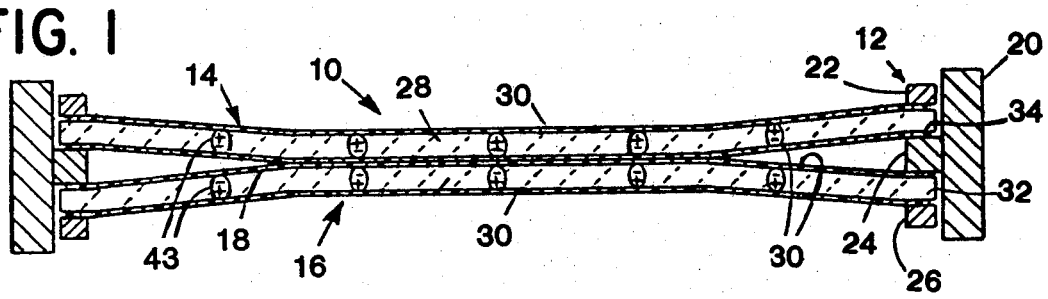
FIG. 1 is a diagrammatic vertical sectional view of an acoustic transducer according to the invention.

In FIG. 1 is shown a microphone having central portion 10 and side portion 12. Films 14, 16 are connected to each other over approximately ⅓ of their total area by epoxy glue 18 (alternatively they can be thermally welded to each other) and are mounted at their peripheries upon cylindrical support 20, between rings 22 and 24, and between rings 24 and 26, respectively. Films 14 and 16 are parallel to each other at their center portions, are conically-shaped (diverging from each other) near their peripheries, and are made of layers 28 (polyvinylidene fluoride or copolymer, 9 microns thick), which are coated with metallized layers 30 of gold 200 A thick, the metallization ending a short distance from the edges of the films and not covering the central part.

The films are polarized to yield strong piezoelectric strain coefficients in both directions (X and Y) of the surfaces of the film surface (commonly noted $d_{31}$ and $d_{32}$) in such a way that the films deform symmetrically with resulting improved efficiency. Polarization vectors 43 of films 14 and 16 are aligned normal to the film surfaces, and the films are mounted in such a way that both vectors point in opposite directions. The films have a diameter of 2.5 cm, and their edges 32, 34 are spaced by 0.5 millimeters.

Figure 2:
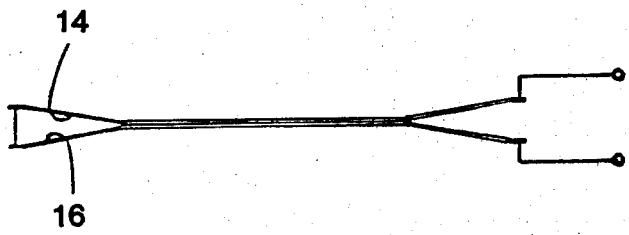
FIG. 2 is an electrical diagram of the FIG. 1 transducer.

In FIG. 2 is represented electrical connection in series of films 14 and 16.

OPERATION

The operation of microphones is well-known. For a given sound pressure level, the output voltage of the microphone involving two films is nearly twice that of a microphone involving only one film, the voltage generated by the two films being added in series.

OTHER EMBODIMENTS

Other embodiments of the invention are within the scope of the appended claims. For example, one need not extend the area that the films are connected together all the way up to one-third of the total area to obtain the advantages of the invention. Also, the polarities could be arranged to add the output currents of the films, and the transducer could be used to produce sound, instead of as a microphone.

What is claimed is:

1. An acoustic transducer comprising a hollow support member, and a plurality of metallized piezoelectric films operating as an oscillator, said films being mounted at their peripheries upon the hollow support member so that their peripheries are spaced apart, and being physically connected at center portions so that the films are parallel to each other throughout said center portions and diverging from each other near their peripharies.

2. The transducer of claim 1 wherein said films are glued together at said center portions by epoxy adhesive.

3. The transducer of claim 1 wherein said films are thermally welded to each other at said center portions.

4. The transducer of claim 1 wherein said transducer is designed to convert sound into an electrical signal, and said films are electrically connected in series with their polarities selected in such a way that the output voltage of each said film is added when said films oscillate.

5. The transducer of claim 1 wherein said transducer is designed to convert sound into an electrical signal, and said films are electrically connected in parallel with their polarities selected in such a way that the current produced by each of the said films is added when said films oscillate.

6. The transducer of claim 1 wherein said transducer is designed to produce sound, and said films are electrically connected with their polarities selected in such a way that said films move in the same direction when electrically excited.

7. The transducer of claim 1 wherein the areas of said center portions are less than or equal to about one-third of the surface area of said films.

* * * * *